US005265996A

United States Patent [19]

Westhoff et al.

[11] Patent Number: 5,265,996

[45] Date of Patent: Nov. 30, 1993

[54] REGENERATIVE PUMP WITH IMPROVED SUCTION

[75] Inventors: Paul E. Westhoff, Chana; Ricky D. Reimers, Rockford, both of Ill.

[73] Assignee: Sundstrand Corporation, Rockford, Ill.

[21] Appl. No.: 850,446

[22] Filed: Mar. 10, 1992

[51] Int. Cl.[5] ..... F01D 1/12

[52] U.S. Cl. ..... 415/52.1; 415/55.1; 416/184

[58] Field of Search ..... 415/52.1, 55.1, 55.5; 416/184, 223 R

[56] References Cited

U.S. PATENT DOCUMENTS

| | | | |
|---|---|---|---|
| 694,980 | 3/1902 | McCornack | 415/52.1 |
| 1,537,732 | 5/1925 | Baumeister | 415/52.1 |
| 2,003,350 | 6/1935 | Durdin | 415/55.5 |
| 3,685,287 | 8/1972 | Dooley | 415/52.1 |
| 4,408,952 | 10/1983 | Schweinfurter | 415/55.5 |
| 4,992,022 | 2/1991 | Aust et al. | 415/55.1 |

FOREIGN PATENT DOCUMENTS

| | | | |
|---|---|---|---|
| 0209092 | 5/1908 | Fed. Rep. of Germany | 415/52.1 |
| 0765809 | 11/1954 | Fed. Rep. of Germany | 416/184 |

*Primary Examiner*—Edward K. Look
*Assistant Examiner*—Mark Sgantzos
*Attorney, Agent, or Firm*—Wood, Phillips, VanSanten, Hoffman & Ertel

[57] ABSTRACT

Poor inlet suction characteristics in regenerative pumps may be avoided in a construction including a housing (10) having an impeller receiving cavity (20) with a circular impeller (22) therein. Channel-like annular grooves (32, 34) are disposed in the housing (10) and open to the cavity (20) at sides (36, 38) of the impeller (22). An outlet seal (63) is located in each of the grooves (32, 34) and outlet ports (62) opening to the grooves (32, 34) are located just upstream of the outlet seal (63). Peripheral recesses (42, 44) are located in the impeller sides (36, 38) and have radially inner extremities (59) located radially inward of the channels (32, 34). A plurality of blades (52) are mounted to the impeller (22) within the recesses (42, 44) around the periphery thereof and have radially inner edges (54) spaced from the radially inner recess extremities (59) while being isolated from recirculation within the channels (32, 34). An inlet port (70) is disposed in the housing (10) and is located between the radially inner extremity of the grooves (42, 44) and the radially inner edges (54) of the blades (52).

17 Claims, 1 Drawing Sheet

FIG. 1
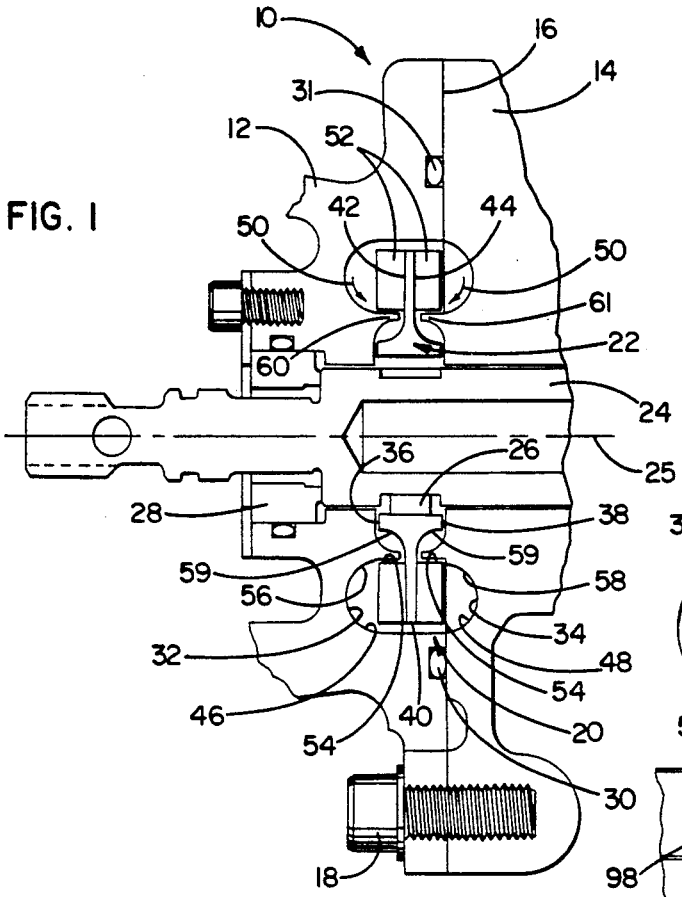
FIG. 4
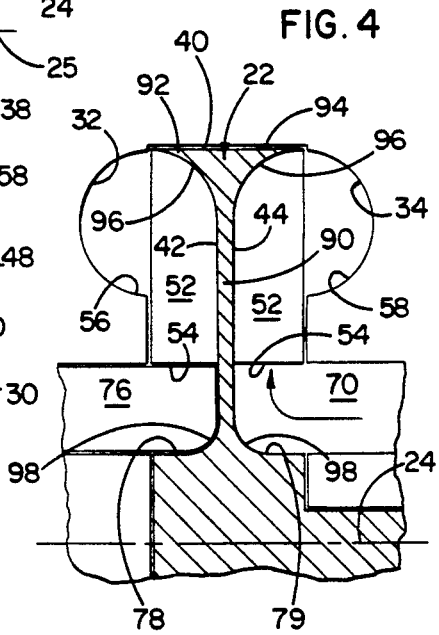
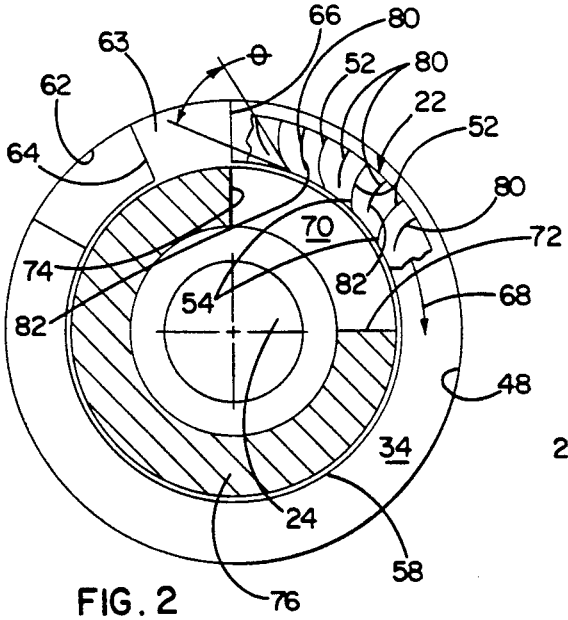
FIG. 2
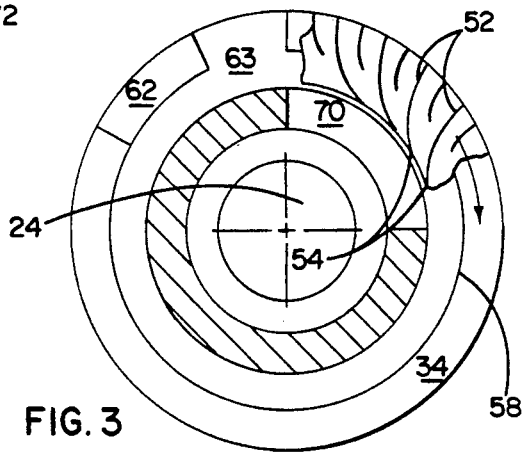
FIG. 3

REGENERATIVE PUMP WITH IMPROVED SUCTION

FIELD OF THE INVENTION

This invention relates to regenerative pumps, and more particularly, to a regenerative pump with improved suction performance at its inlet.

BACKGROUND OF THE INVENTION

Regenerative pumps have found favor in a number of environments where moderate flow rates at relatively high pressures are desired. A typical regenerative pump is capable of delivering fluid at a head two or three times greater than that of a conventional, single stage centrifugal pump. Because of this, where simplicity is desired, resort has been to regenerative pumps to avoid having to utilize multiple stage pumping systems to achieve the desired pressures.

Unfortunately, regenerative pumps heretofore known have had rather poor suction characteristics, particularly when operating upon a liquid near its boiling point. As the pump attempts to draw liquid into the pumping mechanism, the inlet pressure at the pump is reduced and the overall pressure rise and associated volumetric flow delivery of the pump falls off sharply as a consequence of cavitation. And, of course, as the temperature of the liquid being pumped approaches its boiling point, even a small reduction of pressure at the inlet increases the flash off of liquid to vapor, further complicating the cavitation problem.

The present invention is directed to overcoming one or more of the above difficulties.

SUMMARY OF THE INVENTION

It is the principal object of the invention to provide a new and improved regenerative pump. More specifically, it is an object of the invention to provide such a pump with improved inlet suction characteristics.

An exemplary embodiment of the invention achieves the foregoing object in a regenerative pump construction including an impeller mounted for rotation about an axis, a housing containing the impeller within an impeller cavity, and an annular recirculation channel in the housing which opens to the cavity at a side of the impeller. The housing includes an outlet from the channel and a seal blocking the channel just downstream of the outlet. A peripheral recess is located on the impeller on the side thereof facing the channel. The recess extends radially from a location well radially inward of the channel to a location having a substantial radial overlap with the channel. A series of blades are disposed on the side of the impeller within the recess and have radially inner edges located no further radially outward than the radially inner extremity of the channel. The radially inner edges further are radially outward of the radially innermost part of the recess so that an open annulus exists at the radially innermost part of the recess. An inlet is radially aligned with the annulus and an inlet seal extends from the housing into the annulus about the cavity except at the inlet.

As a consequence of the foregoing construction, an inlet for a liquid to be pumped is located at the radially innermost edges of the impeller blade. At this location, of course, for any given annular velocity of the impeller, relative motion between the liquid to be pumped and the blades is the least, thereby minimizing difficulties due to cavitation.

In a highly preferred embodiment, the radially inner edges of the blades are also leading edges for the blades in the direction of impeller rotation and are at a low inlet angle to further improve suction at the inlet.

In a highly preferred embodiment, the radially inner edges or leading edges of the blades are located well radially inward of the radially inner extremity of the channel. This preferred form of the invention provides isolation between occurrences at the inlet and occurrences within the recirculation channel.

In a highly preferred embodiment, the low inlet angle is measured tangentially of the inlet port and is about 20° or less. Even more preferably, the low inlet angle is about 15° or less.

A highly preferred embodiment further contemplates that the blades be curved so as to be concave in the direction of rotor rotation.

The curve is part of a spiral in a highly preferred embodiment.

Additionally, the invention contemplates the provision of splitter blades between the first mentioned blades.

Generally, but not always, the radially inner edges of the blades are parallel to the rotational axis of the impeller. Generally, but not always, the blades have a uniform height across their length.

Other objects and advantages will become apparent from the following specification taken in connection with the accompanying drawings.

DESCRIPTION OF THE DRAWINGS

FIG. 1 is a sectional view of one embodiment of a regenerative pump made according to the invention;

FIG. 2 is a somewhat schematic, side view of part of a pump housing with part of an impeller being illustrated;

FIG. 3 is a view similar to FIG. 2, but of a highly preferred, modified embodiment of the invention; and FIG. 4 is an enlarged, somewhat schematic sectional view of the modified embodiment.

DESCRIPTION OF THE PREFERRED EMBODIMENTS

An exemplary embodiment of a regenerative pump made according to the invention is illustrated in FIG. 1 and is seen to include a pump housing, generally designated 10. The housing 10 is made up of two sections 12 and 14 clamped together on a parting line 16 by a plurality of cap screws 18 (only one of which is shown).

The sections 12 and 14 together define an impeller cavity, generally designated 20, which is substantially filled by a circular, disk-like impeller, generally designated 22 mounted on a shaft 24. A key 26 secures the impeller 22 to the shaft 24 for rotation therewith about an axis 25. The housing 10 may mount one or more sets of bearings for the shaft 24. Also included is a shaft seal 28.

An annular groove 30 in the housing section 12 is adapted to receive an O-ring 31 to seal the inner face of the housing sections 12 and 14 at the parting line 16 and radially outward of the cavity 20.

As can be seen in FIG. 1, the cavity 20 includes a pair of groove-like recirculation channels 32 and 34. The channels 32 and 34 are generally annular about the axis of the shaft 24 except for a so-called outlet seal to be described hereinafter. They both open to the cavity 20 in the axial direction and toward a respective side 36 or 38 of the impeller 22 at a location near its periphery 40. The impeller 22, in turn, includes respective peripheral recesses 42 and 44 on opposite sides. The recesses 42 and 44 have their radially outermost extremity which will be at or near the periphery 40 at or near the radially outermost extremity 46 or 48 of the corresponding channel 32 or 34. As illustrated in FIG. 1, typically the channels 32 and 34 will be of semi-circular cross section to facilitate regenerative flow of fluid as illustrated by arrows 50. Other shapes may be used if desired.

A plurality of blades 52 is located in each of the recesses 42 and 44. The blades 52 have radially inner edges 54 that are located no further radially outward from the axis of the shaft 24 than the radially inner extremity 56 of the channel 32 or the radially inner extremity 58 of the channel 34. As will be seen, in a highly preferred embodiment, it is preferred that the radially inner edges 54 of the blades 52 actually be located substantially radially inwardly of the radially inner extremities 56, 58 of the channels 32 and 34. The radially innermost extremities 59 of the recesses 42, 44 are located well radially inward of the inner extremities 56, 58 of the channels 32, 34.

It will be observed that each of the housing sections 12 and 14 includes a substantially peripheral, annular lip 60, 61 which forms part of an inlet seal (to be described in greater detail hereinafter) and underlies the radially inner edges 54 of the blades 52 at a relatively close clearance. As a consequence of this construction, recirculation within the channels 32 and 34 is essentially forced to take place radially outward of the inner edges 54.

Turning now to FIG. 2, other structural aspects of the embodiment of FIG. 1 will be disclosed in connection with the right hand side of the pump illustrated in FIG. 1, it being understood that the left hand side will be a mirror image of that about to be described.

At any desired location about the channel 34, an outlet port 62 may be located within the housing section 14. Immediately downstream of the outlet port 62 is a so-called outlet seal 63 in the form of an interruption of the channel 34. That is to say, one side 64 of the outlet seal blocks the channel 34 on the downstream side of the outlet port 62 while an opposite side 66 is located a short angular distance away from the side 64 in the direction of rotation of the impeller 22, which direction is illustrated by an arrow 68.

At or about the same angular location as occupied by the side 66 of the outlet seal 63, but radially inward of the radially inner edges 54 of the blades 52 is an inlet port 70. As illustrated, the inlet port 70 has an arcuate extent of approximately 90°, but a greater or lesser angular extent is contemplated depending upon desired design parameters.

Extending from one side 72 of the inlet port approximately three-quarters of the way about the rotational axis of the shaft 24 to the opposite side 74 of the inlet port 70 is a so-called inlet seal 76. The inlet seal 76 may have the configuration closely similar to that of the annulus in the recess 42 or 44 defined by the radially inner extremity 78 or 79 of the recess 42 or 44 and the radially inner extremity 54 of the blades 52 as illustrated in FIG. 4, in connection with the recess 42. Alternatively, the inlet seal 76 may have the configuration of the lip 60 or 61 as illustrated in FIG. 1.

Returning to FIG. 2, the blades 52 are seen to be curved and more specifically, curved to be concave in the direction of impeller rotation 68. However, the blades could be straight if desired. The angle of each blade 52 to the tangential increases in the radial direction. That is, as the distance from the axis 25 increases, the angle Θ will increase. Generally, in choosing blade configuration, it is desirable that the angle Θ be selected so that loading of the blades 52 at their leading edges (or radially inner edges 54) is relatively low. Preferably, but not always, splitter blades 80 will be located between pairs of the blades 52. As is well-known, splitter blades have their radially inner ends 82 well radially outward of the radially inner ends 54 of the main blades 52. The splitter blades keep blockage of the inlet down while maintaining enough blade surface at the radially outer tips to obtain good pressurizing of the fluid being pumped.

According to the invention, the radially inner edges 54 of the blades 52 are the leading edges of the blades 52 considering the direction of impeller rotation as shown by the arrow 68. Preferably, the leading edges are at a low inlet angle for improved suction performance. A low inlet angle will be measured between a line tangent to the surface of the blade 52 at the leading edge 54 and a line tangent to a circle centered on the shaft axis and passing through the leading edge 54, the line also passing through the leading edge 54. That is to say, the last named line will essentially be tangential to the inlet 70. The angle Θ is indicated in FIG. 2 and typically will be about 20° or less. In a preferred embodiment, the angle will be about 15° or less.

A highly preferred embodiment of the invention is illustrated in FIG. 3. In this embodiment, where like structure is employed, like reference numerals are utilized and those components will not be redescribed.

Of particular note in the embodiment of FIG. 3 is the location 58 of the radially inner extremity of the channel 34 in relation to the radially inner edges 54 of the blades 52. It will be observed in both FIGS. 3 and 4 that the recirculation channels 32 and 34 are spaced radially outward of the leading edges 54 by a substantial distance because the radially inner extremities 56 and 58 of the channels 32 and 34 are located well radially outward of the leading edges 54. By so locating the leading edges 54, during pump operation, their relative movement with respect to the incoming fluid at the inlet 70 is reduced because they may be closer to the axis 25 of the shaft 24. As suction performance is inversely proportional to circumferential velocity, lowering such velocity by moving the leading edges 54 radially inward improves suction performance.

In some cases, it may be desirable to close off the recesses 42 and 44 in the side of the impeller 22 near its periphery 40. Thus, as shown in FIG. 4, a web 90 separating the recesses 42 and 44 flares axially as at 92 and 94 to the periphery 40. In general, a generous curve 96 or 98 at both extremities of the recesses 42 and 44 will be desired to reduce turning losses at the inlet 70 and reduce losses in recirculation within the recirculation channels 32 and 34 and the aligned part of the recesses 42 and 44.

From the foregoing, it should be appreciated that a regenerative pump made according to the invention will attain enhanced performance because of improved suction performance. Importantly, as compared to many prior art pumps, the leading edges of the impeller blades are not perpendicular to the axis of rotation. The same are illustrated as parallel to the axis of rotation, but may be of an intermediate value between perpendicular and parallel. This configuration simplifies manufacture of blades with leading edges at relatively low blade angles to enhance suction performance.

The arrangement of components also allows the leading edge of the blades to be located closer to the rotational axis of the impeller to further enhance suction performance.

While the impeller blade height (the length of each blade measured in the axial direction) at the leading edge 54 is illustrated as being the same from the leading edges to the radially outer tips, those skilled in the art will appreciate that such blade height may be varied along the length of the blade as desired. This flexibility allows the designer to optimize the inlet flow angle for best suction performance without significantly affecting the overall head flow characteristic of the pump, particularly when good isolation is maintained between the impeller tips and the recirculation chambers as in the embodiment of FIGS. 3 and 4.

We claim:

1. A regenerative pump comprising:

a housing including an impeller receiving cavity;

a circular impeller within said cavity and substantially filling the same;

means journalling said impeller for rotation about an axis passing through its center and within said cavity;

at least one channel-like annular groove in said housing and opening to said cavity at a side of said impeller;

an interruption in said groove;

an outlet port opening to said groove just upstream of said interruption;

a peripheral recess in said impeller side, said recess having a radially inner extremity radially inward of said groove;

a plurality of blades mounted to said impeller within said recess around the periphery thereof and having radially inner edges spaced from said radially inner extremity while being radially inward of said groove; and an inlet port to said impeller in said casing and between said radially inner extremity and said radially inner edges, said inlet port being on the side of said interruption opposite said outlet port.

2. The regenerative pump of claim 1 further including an inlet seal extending from said casing into said recess between said radially inner edges and said radially inner extremity.

3. The regenerative pump of claim 2 wherein said inlet seal is generally annular, being interrupted generally only by said inlet port.

4. The regenerative pump of claim 1 wherein said radially inner edges are leading edges which lead the remainder of the associated blades in the direction of rotor rotation.

5. The regenerative pump of claim 4 wherein said leading edges are at a low inlet angle measured tangentially of said inlet port.

6. The regenerative pump of claim 5 wherein said low inlet angle is about 20° or less.

7. The regenerative pump of claim 6 wherein said low inlet angle is about 15° or less.

8. The regenerative pump of claim 7 wherein said blades are curved so as to be concave in the direction of rotor rotation

9. The regenerative pump of claim 8 wherein said curve is part of a spiral.

10. The regenerative pump of claim 1 further including splitter blades alternating between said first mentioned blades.

11. The regenerative pump of claim 1 wherein said radially inner edges are generally parallel to said axis.

12. The regenerative pump of claim 1 wherein said blades have a uniform height along their length.

13. A regenerative pump comprising:

an impeller mounted for rotation about an axis;

a housing containing said impeller within an impeller cavity;

an annular recirculation channel in said housing and opening to said cavity at a side of said impeller;

an outlet from said channel;

a seal blocking said channel just downstream of said outlet;

a peripheral recess on said impeller in said side thereof, said recess extending radially from a location well radially inward of said channel to a location having a substantial radial overlap with said channel;

a series of blades on said impeller and in said recess and having radially inner edges within said recess and radially inward of said channel, said blades being non-radial with said inner edges leading in the direction of impeller rotation and spaced from the radially innermost part of said recess to define an open annulus in said recess at the radially innermost part thereof;

an inlet radially aligned with said annulus; and an inlet seal extending from said housing into said annulus about said cavity except at said inlet.

14. The regenerative pump of claim 13 wherein said inner edges are at a low inlet angle.

15. The regenerative pump of claim 14 wherein said low inlet angle is about 20° or less.

16. A regenerative pump comprising:

an impeller mounted for rotation about an axis;

a housing containing said impeller within an impeller cavity;

an annular recirculation channel in said housing and opening to said cavity at a side of said impeller;

an outlet from said channel;

a seal blocking said channel just downstream of said outlet;

a peripheral recess on said impeller in said side thereof, said recess extending radially from a location well radially inward of said channel to a location having a substantial radial overlap with said channel;

a series of blades on said side of said impeller and in said recess and having radially inner edges located no further radially outward than the radially inner extremity of said channel, said blades being non-radial and having leading edges in the direction of impeller rotation defined by said radially inner edges, said radially inner edges further being radially outward of the radially innermost part of said recess so that an open annulus exists at said radially innermost part of said recess;

an inlet radially aligned with said annulus; and an inlet seal extending from said housing into said annulus about said cavity except at said inlet.

17. The regenerative pump of claim 16 wherein said radially inner edges are radially inward of said radially innermost part of said recess.

* * * * *